US007866287B2

(12) United States Patent
Shulver et al.

(10) Patent No.: US 7,866,287 B2
(45) Date of Patent: Jan. 11, 2011

(54) PUMP SYSTEM AND DECOUPLER FOR SUPPLYING PRESSURIZED HYDRAULIC FLUID TO A HYDRAULICALLY ACTUATED VALVETRAIN

(75) Inventors: David R. Shulver, Toronto (CA); Adrian C. Cioc, Oshawa (CA); Matthew Williamson, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 466 days.

(21) Appl. No.: 12/088,876

(22) PCT Filed: Oct. 13, 2006

(86) PCT No.: PCT/CA2006/001678

§ 371 (c)(1), (2), (4) Date: Apr. 1, 2008

(87) PCT Pub. No.: WO2007/041854

PCT Pub. Date: Apr. 19, 2007

(65) Prior Publication Data

US 2008/0216778 A1 Sep. 11, 2008

(51) Int. Cl.
*F01L 9/02* (2006.01)

(52) U.S. Cl. ..... 123/90.12; 123/366; 251/14; 417/390

(58) Field of Classification Search ..... 123/90.12, 123/90.13, 366; 251/14; 417/364, 375, 390
See application file for complete search history.

(56) References Cited

U.S. PATENT DOCUMENTS

| | | | | |
|---|---|---|---|---|
| 5,410,994 | A | 5/1995 | Schechter | |
| 6,553,966 | B2 | 4/2003 | Cornell et al. | |
| 7,357,105 | B2 * | 4/2008 | Moriwaki et al. | 123/90.12 |
| 2006/0157010 | A1 | 7/2006 | Moriwaki et al. | |

* cited by examiner

*Primary Examiner*—Ching Chang
(74) *Attorney, Agent, or Firm*—Harness, Dickey & Pierce, P.L.C.

(57) ABSTRACT

A pump system for supplying pressurized hydraulic fluid to a hydraulic valve actuation system for operating engine valves of an internal combustion engine comprises a substantially conventional main pump, driven by the engine, which supplies the necessary volume of pressurized hydraulic fluid when the engine is running. The system comprises a booster pump that supplies in conjunction with the main pump the necessary volume of hydraulic fluid during starting/cranking of the engine. The main pump is preferably designed and constructed for operating efficiency during engine operating conditions while the booster pump is preferably designed and constructed for operating efficiency during cranking/starting of the engine.

15 Claims, 2 Drawing Sheets

PUMP SYSTEM AND DECOUPLER FOR SUPPLYING PRESSURIZED HYDRAULIC FLUID TO A HYDRAULICALLY ACTUATED VALVETRAIN

FIELD OF THE INVENTION

The present invention relates to a pump system and decoupler for providing pressurized hydraulic fluid to operate engine valves in an internal combustion engine. More specifically, the present invention relates to a pump system and decoupler for providing such hydraulic fluid during start up of the engine.

BACKGROUND OF THE INVENTION

Much development work is underway to produce valvetrains for internal combustion engines which are more controllable than conventional cam-operated valvetrains. For operating efficiency and emission issues, it is desirable to be able to alter valve timing, opening duration and lift amount for internal combustion engines more than has been possible with cam-based systems.

Accordingly, valves operated by hydraulic actuators, under electric control, have been proposed and developed. In such systems, hydraulic fluid is applied to an actuator piston through an electrically controlled valve to move the engine valve to an open position and a conventional valve return spring returns the engine valve to the closed position when hydraulic fluid is returned, thorough the control valve, from the actuator piston.

While such systems show great promise of improvements to engine efficiencies and reduced emissions, their design and implementation involves a variety of challenges. In particular, the pump required to provide the necessary pressurized hydraulic fluid to the actuator pistons of the valve train must be reasonably efficient and yet must be capable of providing the necessary volume of relatively high pressure (approximately 1000 to 3000 PSI or more) hydraulic fluid required to operate the valve train over a wide range of engine operating speeds and conditions.

To date, it has proven difficult to provide an adequate supply of pressurized hydraulic fluid over the range of engine operating speeds from start up of the engine to high speed operating conditions.

SUMMARY OF THE INVENTION

It is an object of the present invention to provide a novel pump system for supplying pressurized hydraulic fluid to a hydraulic actuated valvetrain which obviates or mitigates at least one disadvantage of the prior art.

According to a first aspect of the present invention, there is provided a pump system for supplying pressurized hydraulic fluid to a hydraulic valve actuation system for operating engine valves of an internal combustion engine, comprising: a pump driven by the internal combustion engine, the pump operable to receive hydraulic fluid from a reservoir and to pressurize the fluid and supply the pressurized fluid to the hydraulic valve actuation system during rotation of the engine; and a booster pump driven by a drive member of the internal combustion engine via a decoupler which is operable to couple the booster pump with the drive member when the engine is rotating below a pre-selected speed and to decouple the booster pump from the drive member to stop operation of the booster pump when the engine is rotating above the pre-selected speed, the booster pump being operable to receive hydraulic fluid from the reservoir and to pressurize the fluid and supply the pressurized fluid to the hydraulic valve actuation system during start up of the engine.

According to another aspect of the present invention, there is provided an internal combustion engine having a hydraulic valve actuation system for operating the engine inlet and outlet valves, the engine comprising: a pump driven by the internal combustion engine, the pump operable to receive hydraulic fluid from a reservoir and to pressurize the fluid and supply the pressurized fluid to the hydraulic valve actuation system during operation of the engine; and a booster pump operable to receive hydraulic fluid from the reservoir and to pressurize the fluid and supply the pressurized fluid to the hydraulic valve actuation system during start up of the engine; and a decoupler mechanism operable to couple the booster pump to an engine driven drive member when the engine is being started and to decouple the booster pump from the driven member when the engine is operating.

The present invention provides a pump system for supplying pressurized hydraulic fluid to operate a hydraulic valve train of an internal combustion engine. The system comprises a main pump, driven by the engine, which supplies the necessary volume of pressurized hydraulic fluid when the engine is running. The system further comprises a booster pump which is driven, directly or indirectly, by the engine and which supplies, either solely or in conjunction with the main pump, the necessary volume of hydraulic fluid during starting/cranking of the engine. A decoupler mechanism ensures that the booster pump is only driven by the engine until the engine has started and is rotating above a selected speed. The main pump is preferably designed and constructed for operating efficiency during engine operating conditions while the booster pump is preferably designed and constructed for operating efficiency during cranking/starting of the engine.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
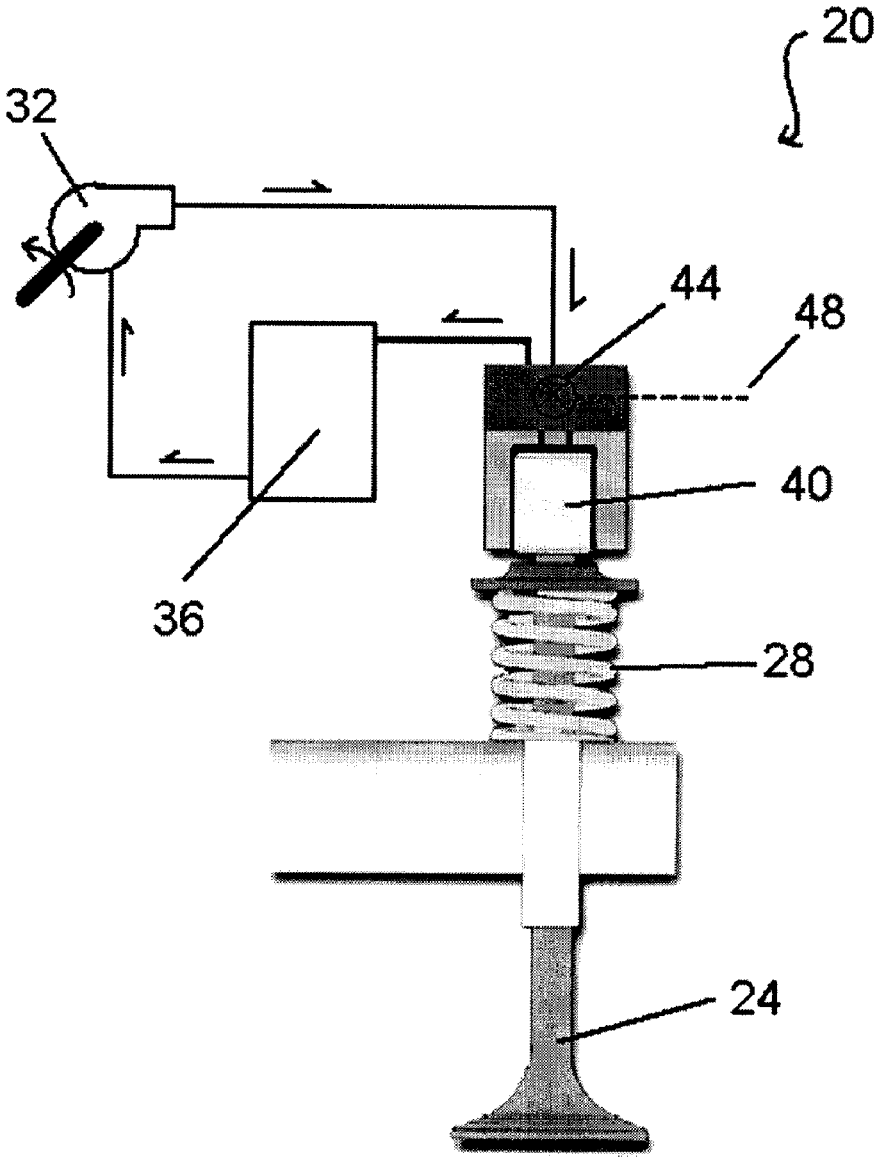
Fig. 1 (prior art)
FIG. 1 shows a schematic representation of a prior art hydraulically operated valve train.

For clarity, before discussing the specifics of the present invention, a prior art hydraulically operated valvetrain system will be discussed, with reference to FIG. 1. The prior art valvetrain system is indicated generally at 20 in FIG. 1 and comprises a conventional engine valve 24 and valve return spring 28.

System 20 further comprises a pump 32 for supplying pressurized hydraulic fluid from a reservoir 36 to a hydraulic actuating piston 40, through a control valve 44. When an appropriate control signal 48 is supplied to control valve 44, control valve 44 allows pressurized fluid from pump 32 to act against actuating piston 40, opening valve 24. When another appropriate control signal 48 is supplied to control valve 44, it blocks the supply of pressurized fluid to actuating piston 40 and allows hydraulic fluid to return to reservoir 36, thus allowing return spring 28 to return valve 24 to the closed position.

For efficiency and reliability reasons, amongst others, it is contemplated that pump 32 will be mechanically driven from the engine of which valvetrain system 20 is part. Thus, pump 32 need be able to provide sufficient volume of pressurized hydraulic fluid over the entire expected operating speed range of the engine, from engine crankshaft starting/cranking speeds of from about 150 PRM to about 250 RPM to maximum operating speeds, depending upon the engine, of about 5000 RPM or more. In the past, it has proven to be difficult to design pump 32 to meet such requirements in a reliable, efficient and cost effective manner.

Figure 2:
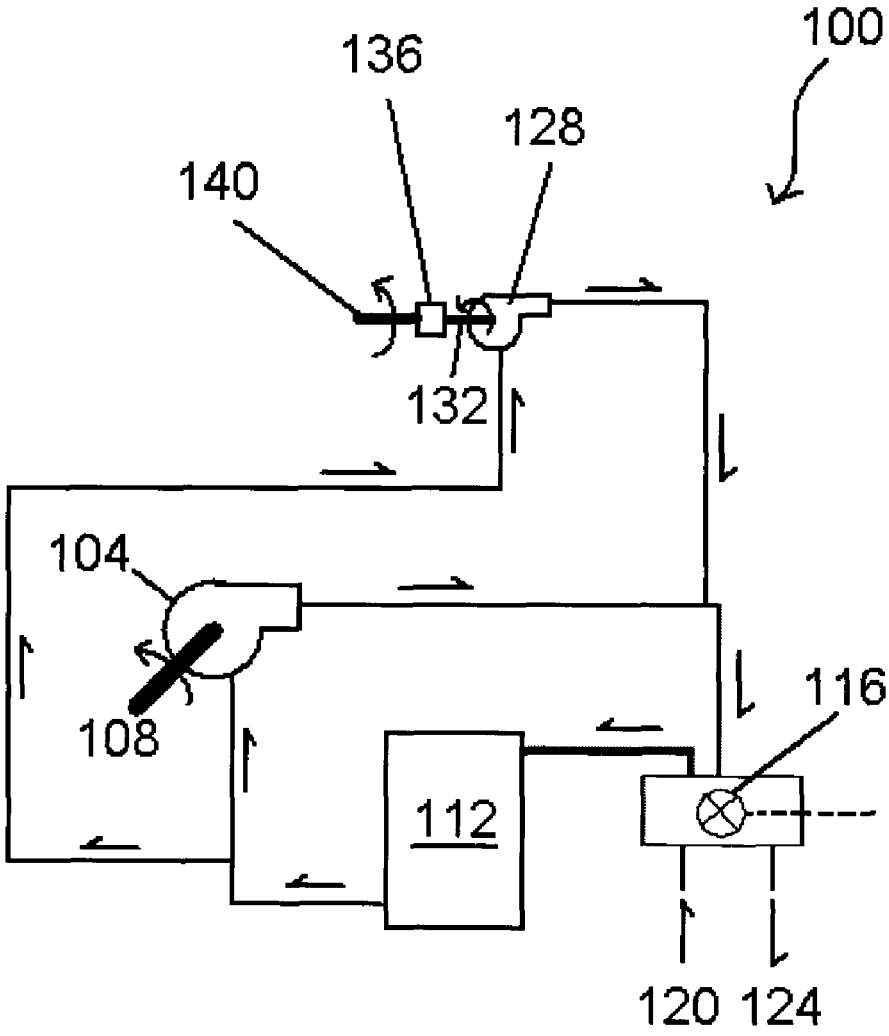
FIG. 2 shows a schematic representation of a pump system in accordance with the present invention.

FIG. 2 shows a pump system 100 for supplying pressurized hydraulic fluid to a hydraulically operated valve train system for an engine, in accordance with the present invention. Pump system 100 includes a substantially conventional main pump 104 for supplying pressurized hydraulic fluid (which can be engine oil, diesel fuel or specific purpose hydraulic fluid) for operation of a valvetrain. Pump 104 is typically driven directly from the engine (not shown), via a drive shaft, gear train or other energy source 108.

Pump 104 is supplied with low pressure hydraulic fluid from a reservoir 112, which can be a tank, the oil sump of the engine, etc., and pressurizes the fluid and supplies it to electrically operated control valves 116 which control the admission of the pressurized hydraulic fluid to 120 and from 124 actuating pistons (not shown) for the engine valves (also not shown).

Pump 104 is designed to provide the necessary supply of pressurized hydraulic fluid when the engine is operating, but is not intended to provide all of the necessary supply of hydraulic fluid during cranking/starting of the engine, although it may contribute a portion of the necessary supply.

Instead, system 100 includes a booster pump 128 to ensure that the necessary supply of pressurized hydraulic fluid is available to operate the valvetrain during starting of the engine. Specifically, booster pump 128 includes an input shaft 132 which is connected, via a decoupler 136, to a drive member 140. When the engine is being started and is not yet rotating within its normal operating speed range, decoupler 136 couples input shaft 132 to rotate with drive member 140.

Drive member 140 is not particularly limited and can be any suitable drive mechanism associated and turning with the engine such as a shaft from an alternator which is driven by a FEAD, or any other belt or chain driven accessory, the drive shaft of the engine lubrication pump, a gear train drive, etc. Drive member 140 can also be a sprocket or pulley driven by a chain or belt drive on the engine. More preferably, if the engine is equipped with a balance shaft mechanism or any other device which is driven at greater than crankshaft speed, such a device is preferred to be employed for drive member 140 as it allows booster pump 128 to rotate at a higher speed for an given engine crankshaft speed.

Similarly, decoupler mechanism 136 is also not particularly limited and can be an electric axial clutch which can, in response to a control signal, couple or decouple input shaft 128 and drive member 140, or can be a centrifugal clutch which couples input shaft 128 and drive member 140 when the latter is rotating below a selected speed and which decouples input shaft 128 and drive member 140 when the latter is rotating above the selected speed.

As mentioned above, when the engine is starting, it is typically rotating at significantly lower speeds than when the engine is operating. Accordingly, booster pump 128 is designed and sized to ensure that the necessary supply of hydraulic fluid is available when input shaft 132 is rotated at the speeds expected during start up of the engine. It is presently expected that the necessary supply of hydraulic fluid will be obtained from the combined outputs of main pump 104 and booster pump 128, but it is also contemplated that, in some circumstances, booster pump 128 can provide all of the necessary supply independent of main pump 104.

Once the engine starts and begins to rotate at speeds sufficient for the main pump 104 to operate efficiently, decoupler 136 decouples booster pump 128 from drive member 140 to stop operation of booster pump 128 to prevent cavitation and/or other undesired effects which would occur if booster pump 128 was driven at speeds above its intended operating range.

As booster pump 128 is only intended to provide a supply of pressurized hydraulic fluid during start up of the engine, it is designed and sized to efficiently provide the expected required volume of hydraulic fluid at the necessary pressure. It is contemplated that booster pump 128 can be a fixed displacement gear pump, a gerotor pump, or the like. When booster pump 128 is operating, pressurized fluid from booster pump 132 is supplied, solely or in conjunction with pressurized fluid from main pump 104, to control valves 116 to operate the valves of the engine.

By removing the need for pump 104 to operate efficiently and supply all pressurized hydraulic fluid during cranking/starting of the engine (which occurs at relatively low engine rotation speeds) the design and construction of main pump 104 can be better optimized for its normal operating requirements. Similarly, as booster pump 128 need only operate at the narrow range of speeds experienced during starting of the engine, the design and construction of booster pump 128 can also be better optimized for its normal operating requirements.

The present invention provides a pump system for supplying pressurized hydraulic fluid to operate a hydraulic valve train of an internal combustion engine. The system comprises a substantially conventional main pump, driven by the engine, which supplies the necessary volume of pressurized hydraulic fluid when the engine is operating. The system further comprises a booster pump which is driven, directly or indirectly, by the engine and which supplies, either solely or in conjunction with the main pump, the necessary volume of hydraulic fluid during starting/cranking of the engine. A decoupler mechanism ensures that the booster pump is only driven by the engine during start up, and is thus only rotated below a selected speed. The main pump is preferably designed and constructed for operating efficiency during expected normal operating conditions of the engine while the booster pump is preferably designed and constructed for operating efficiency during cranking/starting of the engine.

The above-described embodiments of the invention are intended to be examples of the present invention and alterations and modifications may be effected thereto, by those of skill in the art, without departing from the scope of the invention which is defined solely by the claims appended hereto.

We claim:

1. A pump system for supplying pressurized hydraulic fluid to a hydraulic valve actuation system for operating engine valves of an internal combustion engine, comprising:

a pump driven by the internal combustion engine, the pump operable to receive hydraulic fluid from a reservoir and to pressurize the fluid and supply the pressurized fluid to the hydraulic valve actuation system during rotation of the engine; and a booster pump driven by a drive member of the internal combustion engine via a decoupler which is operable to couple the booster pump with the drive member when the engine is rotating below a pre-selected speed and to decouple the booster pump from the drive member to stop operation of the booster pump when the engine is rotating above the pre-selected speed, the booster pump being operable to receive hydraulic fluid from the reservoir and to pressurize the fluid and supply the pressurized fluid to the hydraulic valve actuation system during start up of the engine.

2. The pump system of claim 1 wherein the hydraulic fluid is engine lubricating oil.

3. The pump system of claim 2 wherein the reservoir is the sump of the engine.

4. The pump system of claim 1 wherein the hydraulic fluid has a lower viscosity than the engine lubricating oil.

5. The pump system of claim 4 wherein the engine is a diesel engine and the hydraulic fluid is diesel fuel.

6. The pump system of claim 1 wherein the drive member is a belt driven accessory on the engine.

7. The pump system of claim 1 wherein the drive member is a rotating member of the engine.

8. The pump system of claim 1 wherein the drive member is a pulley rotated by an engine driven belt.

9. The pump system of claim 1 wherein the drive member is a sprocket rotated by engine driven chain.

10. The pump system of claim 1 wherein the rotating member is the engine crankshaft.

11. The pump system of claim 1 wherein the rotating member is the drive shaft of an engine lubricating pump.

12. The pump system of claim 1 wherein the drive member rotates at a greater speed than the crankshaft of the engine.

13. The pump system of claim 1 wherein the decoupler is electrically controllable and an electric control signal is applied to the decoupler when the pre-selected speed is obtained to decouple the drive member and the booster pump.

14. The pump system of claim 1 wherein the decoupler employs centrifugal force to decouple the booster pump from the drive member.

15. An internal combustion engine having a hydraulic valve actuation system for operating the engine inlet and outlet valves, the engine comprising:

a pump driven by the internal combustion engine, the pump operable to receive hydraulic fluid from a reservoir and to pressurize the fluid and supply the pressurized fluid to the hydraulic valve actuation system during operation of the engine; and a booster pump operable to receive hydraulic fluid from the reservoir and to pressurize the fluid and supply the pressurized fluid to the hydraulic valve actuation system during start up of the engine; and a decoupler mechanism operable to couple the booster pump to an engine driven drive member when the engine is being started and to decouple the booster pump from the driven member when the engine is operating.

* * * * *